US009119978B1

(12) United States Patent
Bassett

(10) Patent No.: US 9,119,978 B1
(45) Date of Patent: Sep. 1, 2015

(54) SAFETY LOWERING DEVICE

(71) Applicant: Carroll C. Bassett, Friars Hill, WV (US)

(72) Inventor: Carroll C. Bassett, Friars Hill, WV (US)

( * ) Notice: Subject to any disclaimer, the term of this patent is extended or adjusted under 35 U.S.C. 154(b) by 15 days.

(21) Appl. No.: 13/732,291

(22) Filed: Dec. 31, 2012

Related U.S. Application Data

(60) Provisional application No. 61/631,249, filed on Dec. 30, 2011.

(51) Int. Cl.
*A62B 1/04* (2006.01)
*A62B 1/14* (2006.01)

(52) U.S. Cl.
CPC .... *A62B 1/14* (2013.01); *A62B 1/04* (2013.01)

(58) Field of Classification Search
CPC ..... A62B 1/04
USPC ..... 182/193; 188/65.5
See application file for complete search history.

(56) References Cited

U.S. PATENT DOCUMENTS

| | | | | | |
|---|---|---|---|---|---|
| 55,053 | A | * | 5/1866 | Brown | 188/65.3 |
| 288,411 | A | * | 11/1883 | Connolly | 182/7 |
| 666,879 | A | * | 1/1901 | White | 188/65.3 |
| 1,087,440 | A | * | 2/1914 | Freed | 182/11 |
| 4,311,218 | A | * | 1/1982 | Steffen | 188/65.4 |
| 5,295,559 | A | * | 3/1994 | Nutkins | 188/65.4 |
| 6,131,697 | A | * | 10/2000 | Bassett | 182/5 |
| 2009/0120720 | A1 | | 5/2009 | Arms | |
| 2010/0236863 | A1 | | 9/2010 | Schwarzenbach et al. | |
| 2011/0048852 | A1 | | 3/2011 | Wolf et al. | |
| 2012/0261212 | A1 | | 10/2012 | Bonaiti | |

* cited by examiner

*Primary Examiner* — Alvin Chin-Shue
(74) *Attorney, Agent, or Firm* — Johnston Holroyd; Mary-Jacq Holroyd

(57) ABSTRACT

A U-shaped frame supporting three bars of circular cross section movable along the arms of the rod, enlarged abutments on the free ends of the rod preventing removal of the bars, and the first bar being attached to a handle so that the bar may be moved up/down the arms by holding/releasing the handle.

20 Claims, 10 Drawing Sheets

SAFETY LOWERING DEVICE

RELATED APPLICATIONS

This application claims the benefit of U.S. Provisional Application Ser. No. 61/631,249 entitled "SLD (Safety Lowering Device)" filed on 30 Dec. 2011, the contents of which are incorporated herein by reference in its entirety.

BACKGROUND OF THE INVENTION

Emergency descent control devices are known. U.S. Pat. No. 6,131,697 teaches a rappelling rope controller which utilizes a U-shaped rod supporting three bars of circular cross section movable along the arms of the rod, and enlarged abutments on the free ends of the rod preventing removal of the bars, but no mechanism for releasing the load are present. US Patent Application No. 2010/0236863 teaches an auto-lock compact rope descent device is a bar with holes for guiding a rope used is descent, and a lever designed to pivot or move relative to the bar and compresses the opening of one of the holes. Compressing the opening increases friction and slows or stops descent.

US Patent Application No. 2012/0261212 teaches an anti-panic descender with possibility of ascent that uses a lever. US Patent Application No. 2011/0048852 teaches a descender with fall arrest and controlled rate of descent. US Patent Application No. 2009/0120720 teaches a frictionless descender for abseiling along a rope that also has a handle to control descent. These devices do not show the internal rigging of the rope, and therefore, are not as easy to inspect. Most of these devices provide two loops in a threaded rope, and use a breaking action provided by the lever to slow the movement.

SUMMARY OF THE INVENTION

The present invention involves a safety lowering device (SLD) that is a descent control device designed specifically to increase the safety and speed of technical rope rescue operations. This device overcomes a number of potential safety concerns with respect to other descent control devices currently available. A primary advantage of the present invention is its ability to automatically lock off the rope thereby stopping unattended descent. This means that if the user, while using the SLD, becomes incapacitated, the device will automatically stop the progress of the lowering operation avoiding potential injury to patients and attendants. Although this is a relatively uncommon occurrence within the technical rescue community, devices passing this so-called whistle test have gained enthusiastic acceptance for their increased levels of safety.

A further aspect to this invention is its potential for multi-functional use. Besides its use for the lowering of rescue loads up to about six hundred pounds (600 lbs.), the SLD can easily and almost instantly be converted to function as a simple-to-operate rescue belay device. In the event that the belay function becomes locked-up during use, this device can quickly be converted to the lowering function after remedying the issue that caused the lock-up. This aspect will allow users of two rope systems, for belay and lower, to use one device for both functions simplifying training and reducing the risk of skill retention issues when using different devices.

In a primary embodiment of this invention, the rope may be pre-rigged by receiving the rescue rope through the device. In this configuration, the rope cannot become detached from the device unless the rope is physically pulled through the device during its use. To eliminate this possibility, stopper knots are tied on the ends of the rope. This is done prior to the rescue event and is known as pre-rigging, a practice that eliminates potential errors in the heat of a rescue as well as accelerating the rigging process during the rescue event.

Another important aspect of this invention is that all components are completely visible without any disassembly which in turns allows a complete inspection to determine if the device has undergone any wear or damage that might compromise its safety.

A further advantage of the present safety device is its ability to compensate for shock loads potentially encountered in rescue scenarios. Almost all other descent control devices when locked off do not have the ability to allow limited slippage of the rope through the loaded device. If a device that does not allow limited slippage under load is suddenly shock loaded the majority of this potentially large force must be dissipated in the rest of the system with the potential of over-stressing a component and leading to a possible catastrophic failure.

In scenarios where more than one individual will require lowering, it is important to be able to resent the system quickly and safely. High rise rescues during fire events have multiple rescuers using single lines.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings. The drawings, which are not drawn to scale, are for illustration of design principles and parts.

Similar reference characters denote corresponding features consistently throughout the attached drawings.

DETAILED DESCRIPTION OF PREFERRED EMBODIMENTS

Figure 1:
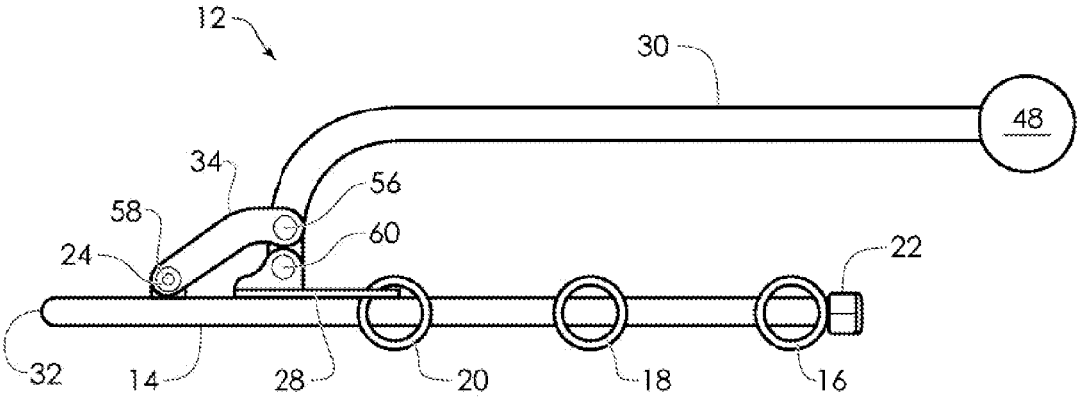
FIG. 1 is a side view of an unrigged embodiment of the present invention.
Figure 2:
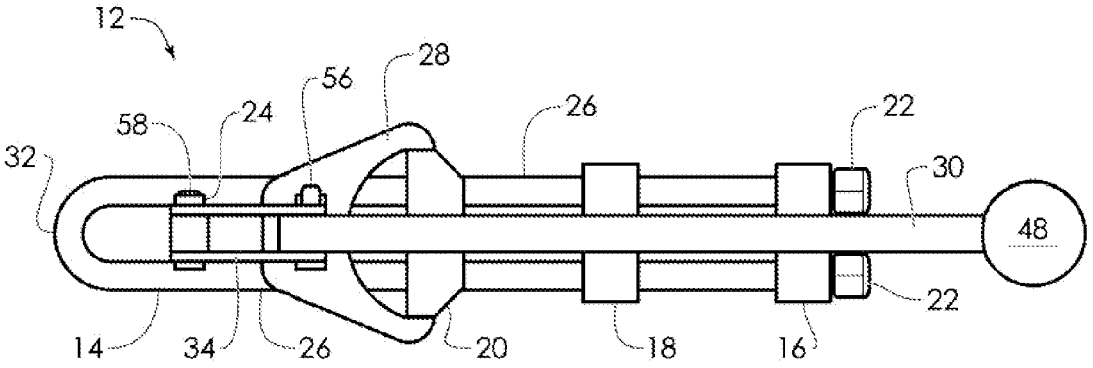
FIG. 2 is a top view of an unrigged embodiment of the present invention depicted in FIG. 1.

FIGS. 1 and 2 show the safety lowering device 12 in both side and top views prior to being rigged. The safety device 12 is primarily composed of a U frame 14 upon which is affixed three (3) movable bars 16, 18, and 20 which are free to slide along the U frame 14 and held in place by two (2) abutments 22, e.g. locknuts attached to the ends of the U frame 14. A shoulder retainer 24, e.g., screw, is affixed between parallel arms 26 of the U frame 14 which serves as an anchor point for unloader components. The shoulder retainer 24 may be attached to a block 28 affixed between the arms 26, as shown.

To use the safety device 12 as an effective rescue belay device the unloader components can be detached by removing the shoulder retainer 24, e.g., screw, and swinging a bar clip 28 off of the third bar 20. Although the present invention is described using a U frame 14, the frame 14 of the present invention may instead be made of components having two parallel arms and a closed end 32 which may be attached to an anchor, have a rope R threaded through it, or the like.

Figure 3:
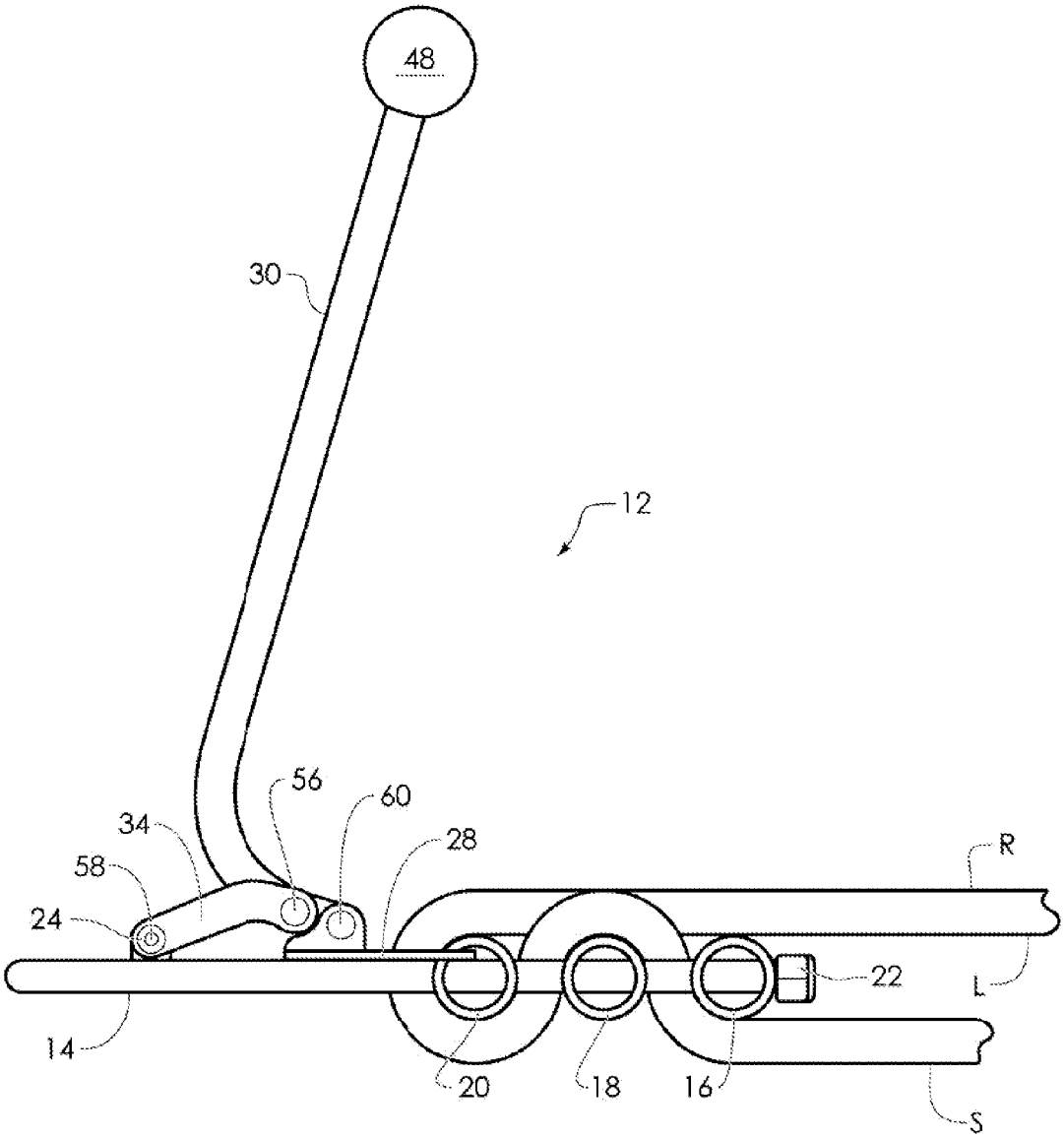
FIG. 3 is a side view of an embodiment of the present invention rigged (with a rope threaded through) depicted in FIGS. 1 and 2.

FIG. 3 is a side view of a rigged version of the present invention shown in FIGS. 1 and 2. The rope R, which has two ends (or sides) and a length, is threaded between the bars 16, 18, and 19 as shown, and a load (not shown) is suspended from one end (or along one side) of the rope with the load end of the rope R being depicted with an L and the slack end (side) being depicted with an S. If a load L is applied to the rope R, then the bars 16, 18, and 20 are pulled in a direction that effectively traps the rope R between the bars 16, 18, and 20 thereby applying a strong breaking action on the rope R directly proportionally to force exerted by the load.

To allow rope to be played out of the device 12, it should be apparent that the bars 16, 18, and 20 will need to be separated when the device is loaded. This is accomplished by means of the unloader components of the safety device 12 which in turn supplies a mechanical advantage to separate the bars when the lowering lever 30 is moved towards abutments 22. Depending on the amount of movement of the lever 30, friction is reduced, and the rope R under load is let out with full control. Releasing the lowering lever 30, automatically allows the bars 16, 18, and 20 to move back together thus trapping the rope R between them and stopping the descent.

Figure 4A:
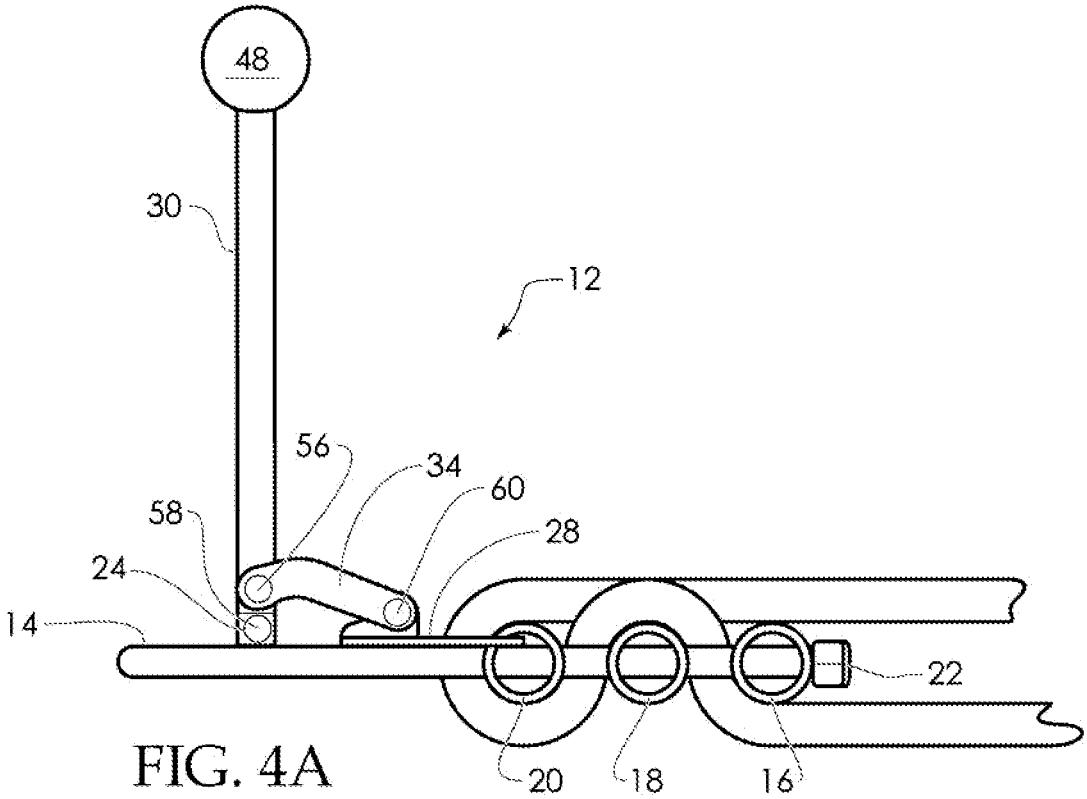
FIGS. 4A and 4B are side views of alternative embodiments of the present invention with alternative handle mechanisms as shown from the same position as FIG. 3.
Figure 4B:
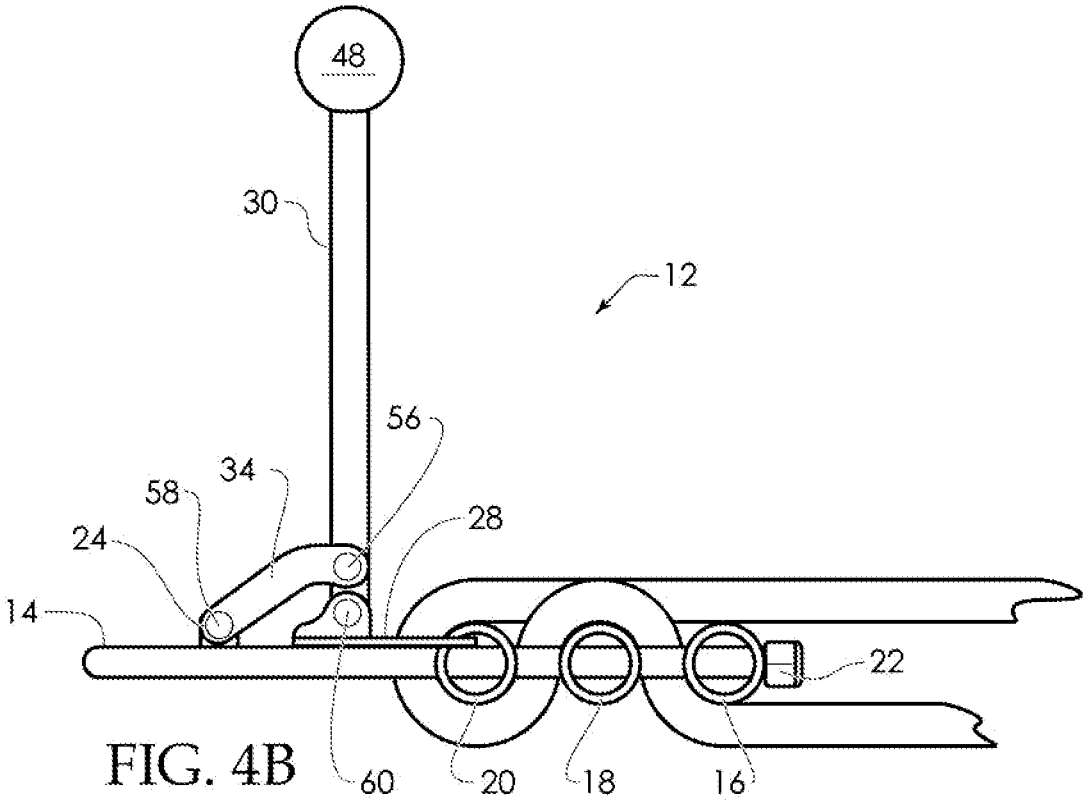

Further embodiments of the present design are depicted in FIGS. 4A and 4B. Variations of the configuration of components employed for the lowering function (unloading). This allows the lowering function to be altered during manufacture depending on whether moving the lowering ever in one direction of the other better suits a particular rescue protocol.

Figure 5A:
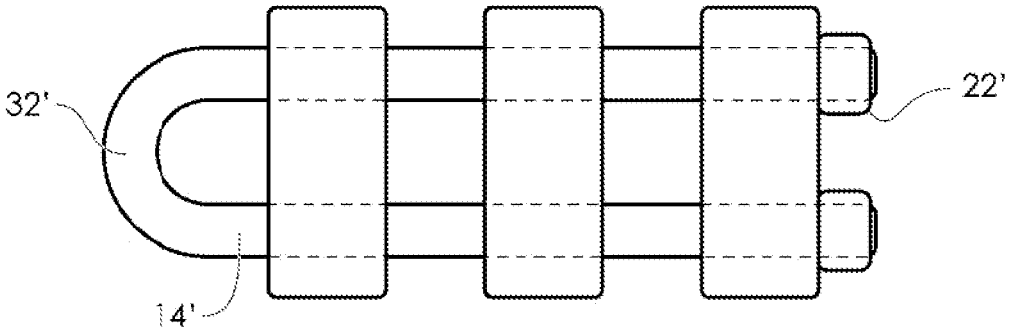
FIG. 5A PRIOR ART
FIGS. 5A through 5C are alternative views of the prior art device.
Figure 5B:
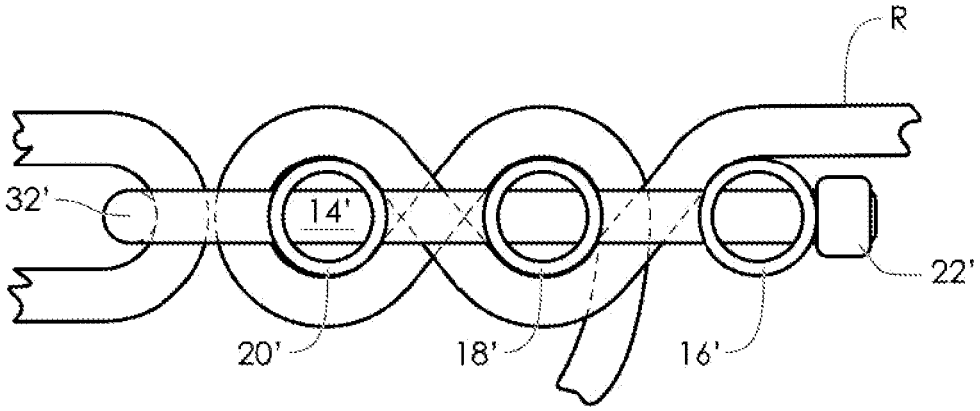
FIG. 5B PRIOR ART
Figure 5C:
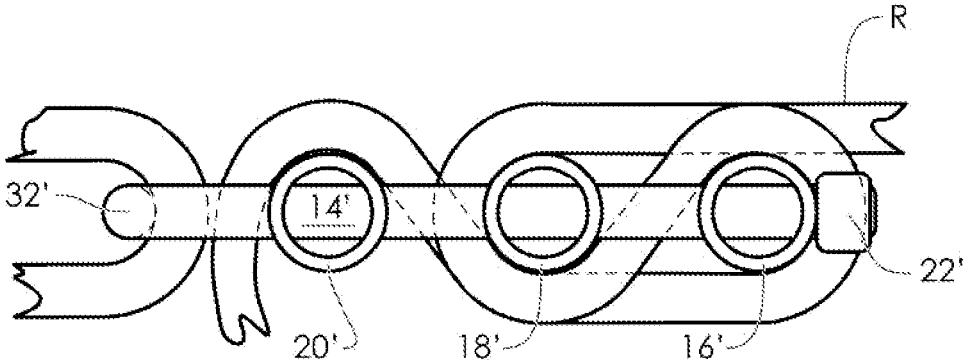
FIG. 5C PRIOR ART

FIGS. 5A through 5C shows a prior art device, U.S. Pat. No. 6,131,697, the contents of which are incorporated herein in their entirety, which utilizes a similar configuration. As a reference to the configuration, and although rigged differently, demonstrates the principle of the bars squeezing the rope thereby creating friction when the device is loaded.

Figure 6A:
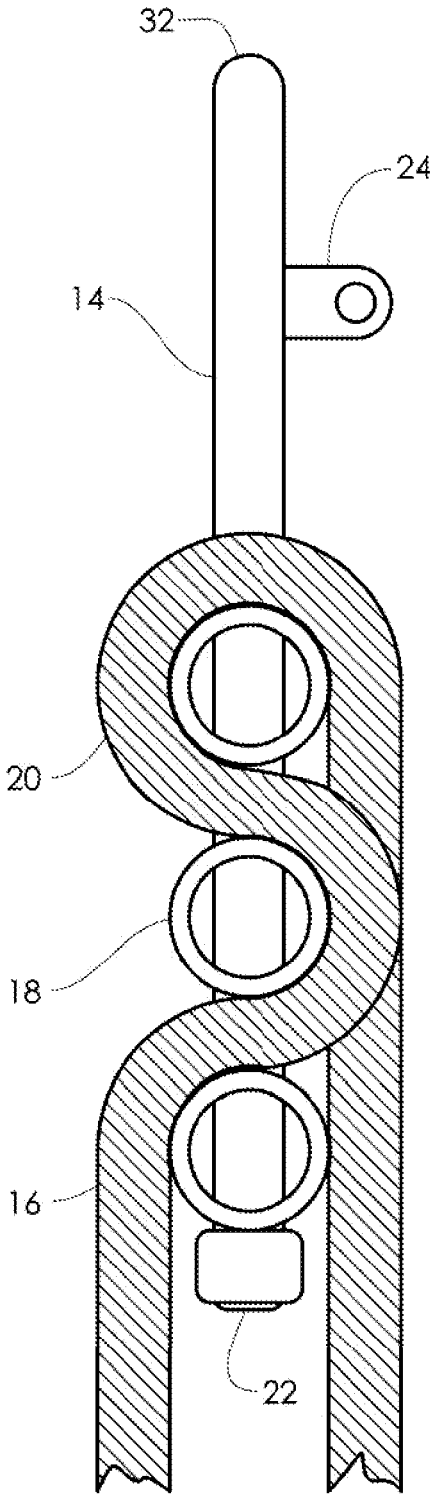
FIGS. 6A and 6B are side and top views respectively of an embodiment of the present invention with handle and plate removed.
Figure 6B:
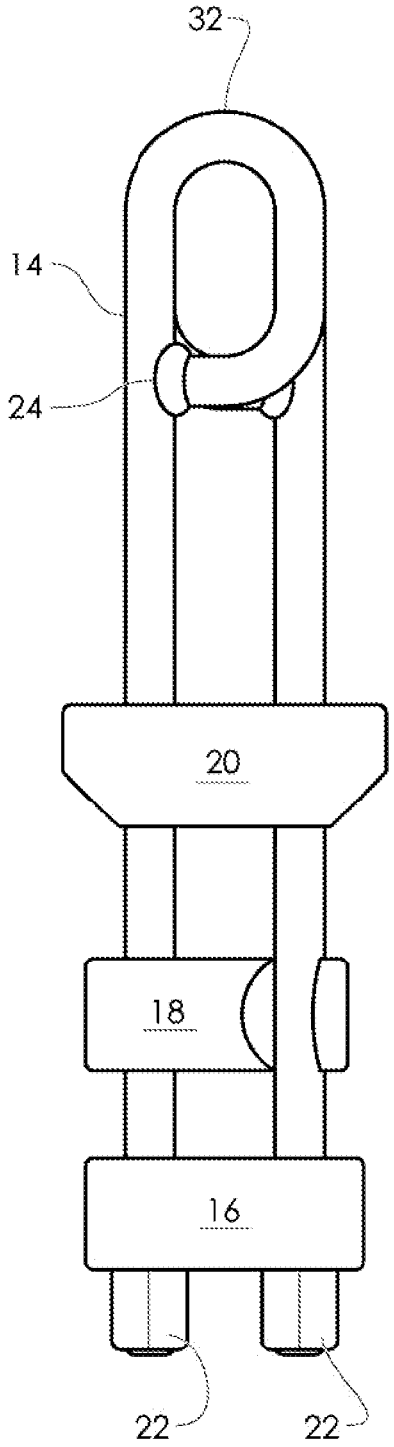

FIG. 6A shows the safety lowering device 12 reeved to function as a rescue belay device. Removal of the unloader components is required for this conversion. should the rescue requirements demand that the device be used to lower the rescue load, the unloader components can be reattached very quickly. FIG. 6B shows an alternative embodiment of the present design, in which the basic safety lowering device 12 U frame 14 replaced with two (2) rods with welded eyes formed on their ends. FIG. 6B has an alternative form of the U Frame 14 in which the two (2) rods with welded eyes have a middle bar 18 which swings open to allow attachment in the middle of the rope. The unloading components are not shown in FIGS. 6A and 6B.

This embodiment will allow the device 12 to be installed in the middle of a rescue rope R without needing to thread the rope from its end through the device. The anchor point 32 for the unloader components would be attached to one of these frame 14 elements to allow them to rotate independently from one another allowing midline attachment. It should also be noted that the middle bar 18 will not only be easily slidable but also be able to swing away from the frame to allow midline attachment. Further regarding FIGS. 6A and 6B, the functioning of the middle bar 18 which has a notch disposed to accommodate one arm of the frame 14 and an opening through to accommodate the other arm of the frame 14. The middle bar 18 swings out to accommodate a rope R and then held by force in place as shown in FIG. 6A.

Figure 7:
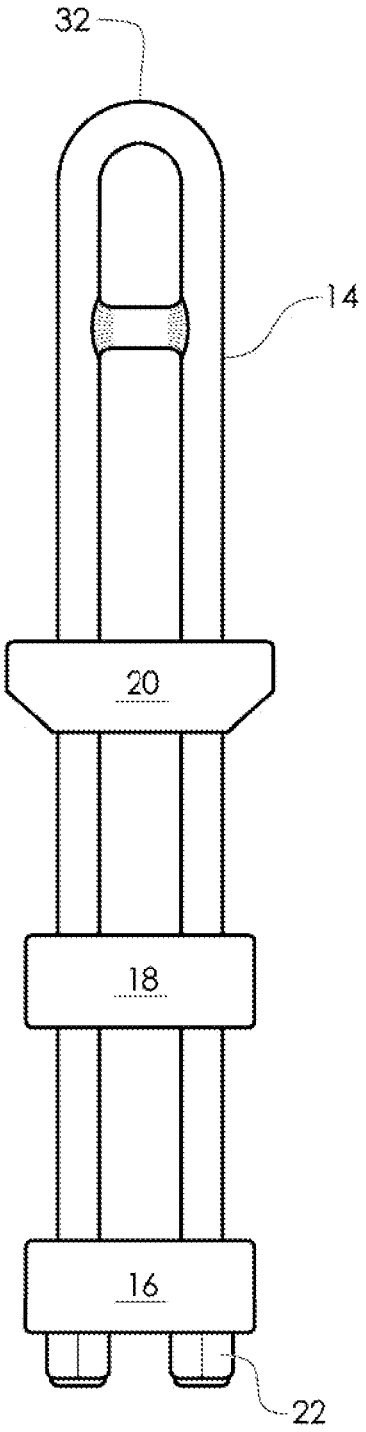
FIG. 7 is a top view of an embodiment of the present design with the handle and plate removed.
Figure 8:
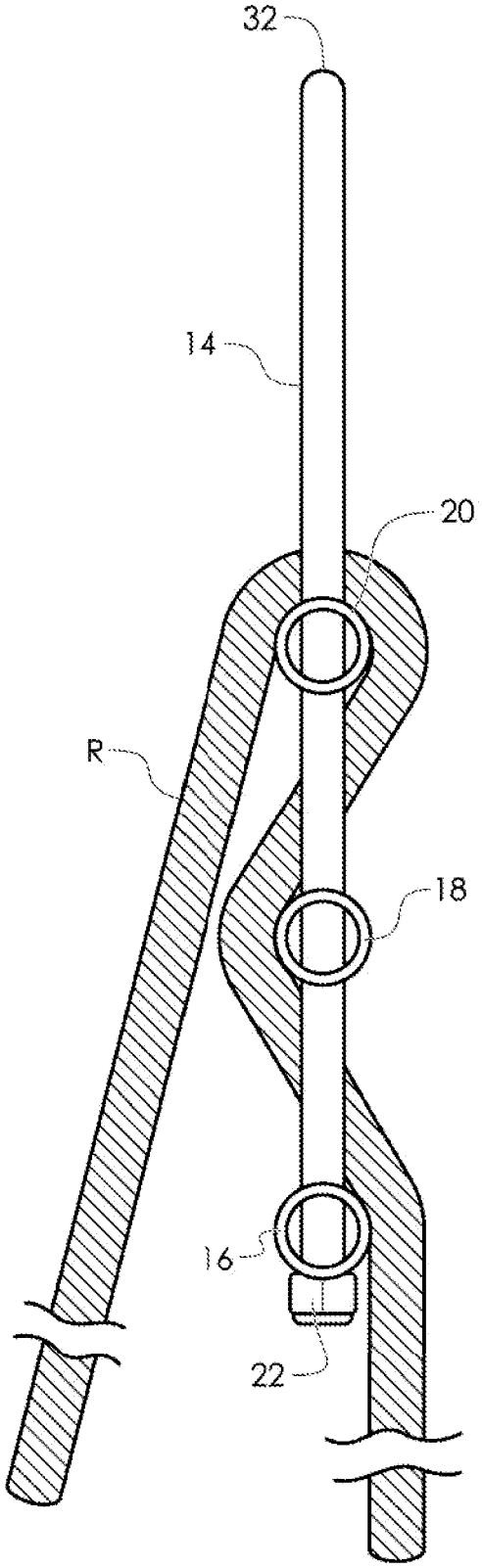
FIG. 8 is a side view of a threaded embodiment of the present design with the handle and plate removed.

FIGS. 7 and 8 show a basic prerigged version of the present invention, which will not allow the rope R to become separated from the device. In this embodiment of the present design, the bars do not open but slide along the frame. To reeve this device, the rope R must be threaded between the bars as shown in FIG. 8. It is recommended that a crimped eye or sewn eye be used on the load end of the rope to avoid any issues with tied knots. Since the rope travels at right angles to the bars, rope hockling is eliminated. when rigged as in FIG. 8, this device is a very effective belay device capable of arresting 600 pounds dropped loads without undue stress to the anchor systems. The anchor or other equipment is attached at the closed end of the U Frame 14 at 32. When couple with the unloader, it functions as an easily controlled lowering device with the added function of automatically stopping descent of the load when unattended or released.

Figure 9A:
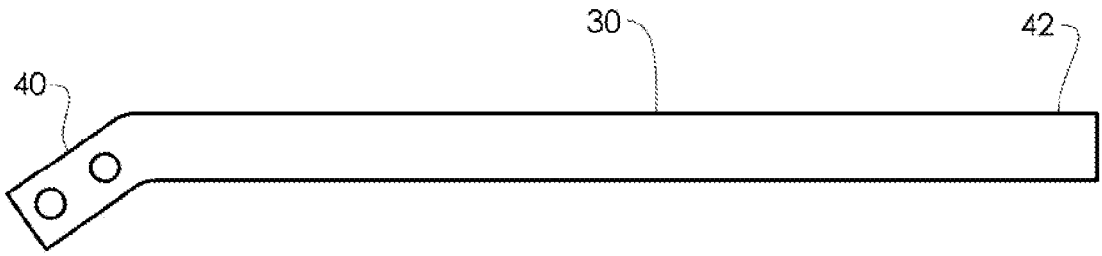
FIGS. 9A through 9C are side and top views of a handle and plate attachments.
Figure 9B:
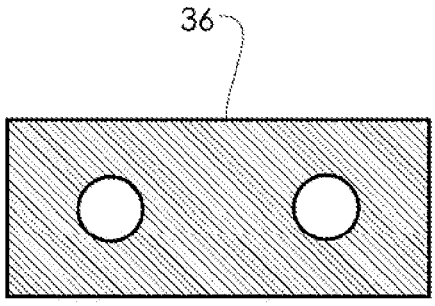
Figure 9C:
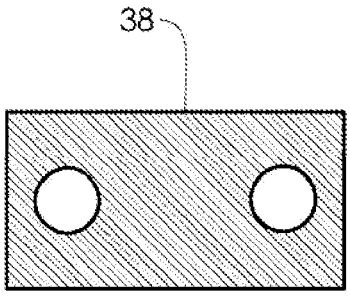

FIGS. 9A through 9C show greater detail depicting the simplest handle 30 in FIG. 9A, and two bars in FIGS. 9B and 9C. The handle 30 has a first end 40 with openings or axles therethrough as shown to accommodate limited rotation thereabout during operation of the unloading. FIGS. 9B and 9C show the openings through the bars with a wider bar 36 and a narrower bar 38. The wider bar 36 may be used as the third bar 16 and/or the first bar 20, with the narrower bar 38 used as the second (middle) bar 18.

In the embodiment depicted in FIG. 6B, one of the openings through the narrower bar 38 has been cut out through the side as shown in FIG. 6B, and discussed hereinbefore. The dimensions of the wider bar 36 in a prototype embodiment are 2.5 inches by 1.05 inches with the two openings accommodating ¾inch pipe and 0.779 inches between the openings. In the narrower bar 38 in a prototype embodiment are two inches by 1.05 inches with the two same two openings as the wider bar 36.

Figure 10A:
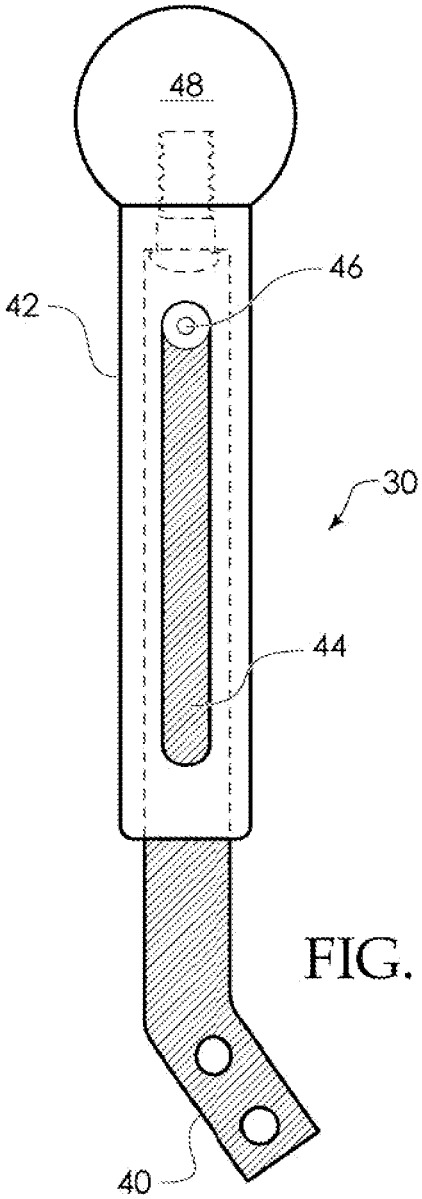
FIGS. 10 A and 10B are side views of an elongated, or telescoping, handle according to an embodiment of the present design.
Figure 10B:
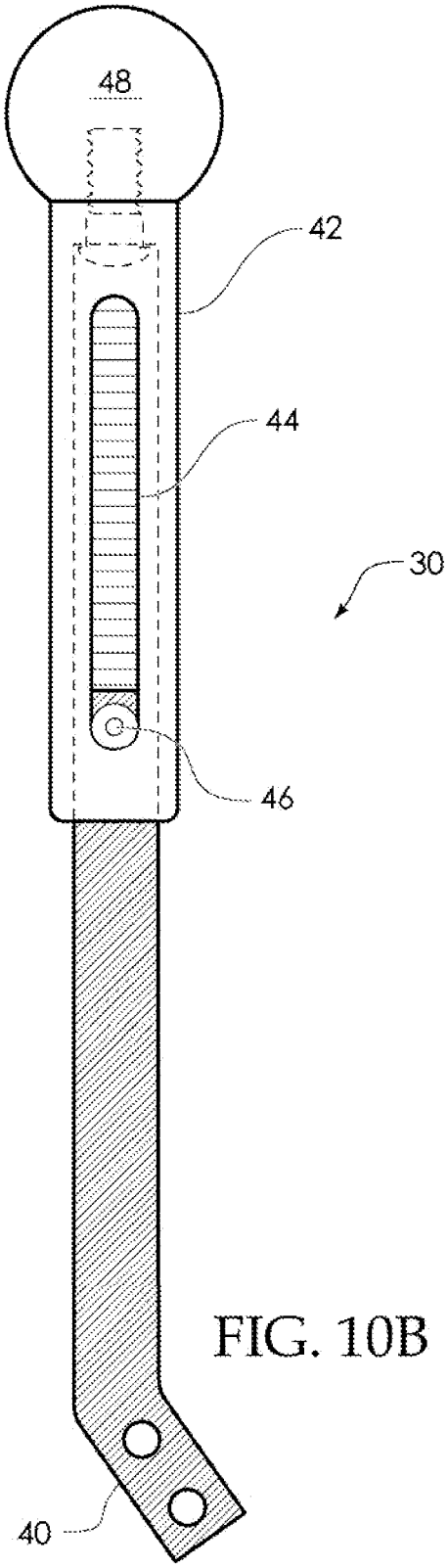

The simplest handle 30 (or handle base) has a second end 42 that may additionally have a grip 48 (not shown in FIG. 9A) or a telescoping part with a slot 44, shown in FIGS. 10A and 10B, disposed thereon. The handle 30 of a prototype embodiment has a dimension of 10.25 inches long with a ¼inch diameter, while the handle base 30 for the telescoping handle. There is a 35 degree bend at the first end 40. With the telescoping handle, the handle base 30 is 7.24 inches long in another prototype embodiment. Stainless steel (304) was used.

Further regarding the telescoping handle 30 of FIGS. 10A and 10B, the slide handle part has a round nose spring plunger 46 threads into bent half of handle and holds the handle in position from pressure applied by the ball nose element to the inside of the sliding section. In the prototype embodiment, the sliding section would be rotated ninety degrees from that shown in the figures placing the slot on the bottom of the handle for maximum strength. The sliding section from 20 millimeter diameter aluminum.

Figure 11A:
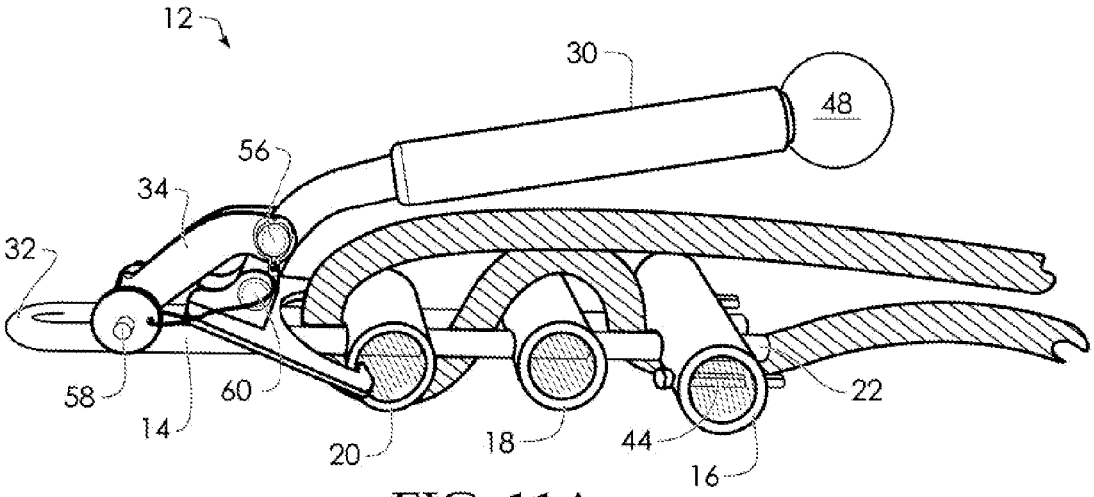
FIGS. 11A and 11B are elevated environmental views of an alternative embodiment of the present design demonstrating the functionality thereof.
Figure 11B:
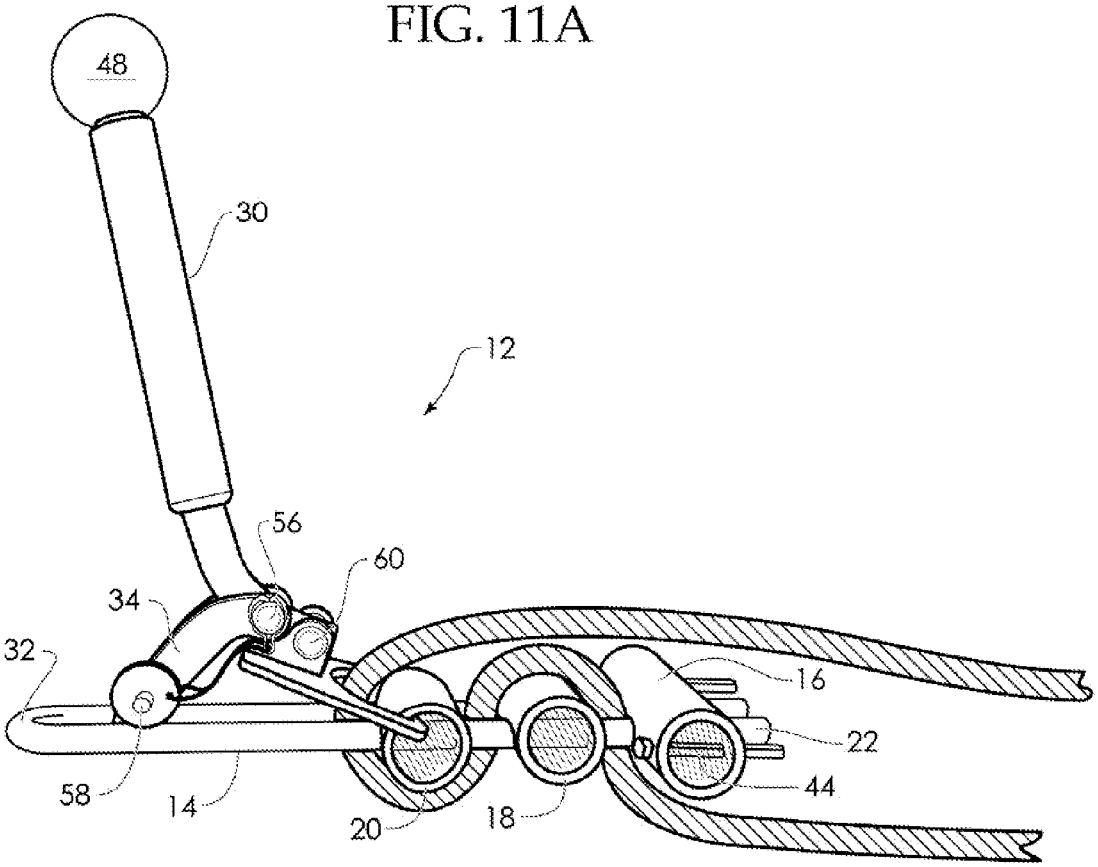

FIGS. 11A and 11B are perspective views demonstrating the release, or lowering, position in FIG. 11A, and the belay position in FIG. 11B with the handle 30 being released. The handle must be held in the position shown if FIG. 11A with the handle 30 away from the anchor 32. In FIG. 11B, the handle 30, which is released, is up or forward towards the anchor 32. As can be seen from the perspective views of FIGS. 11A and 11B, the present does not lay as flat as shown in some of the other figures.

Figure 12:
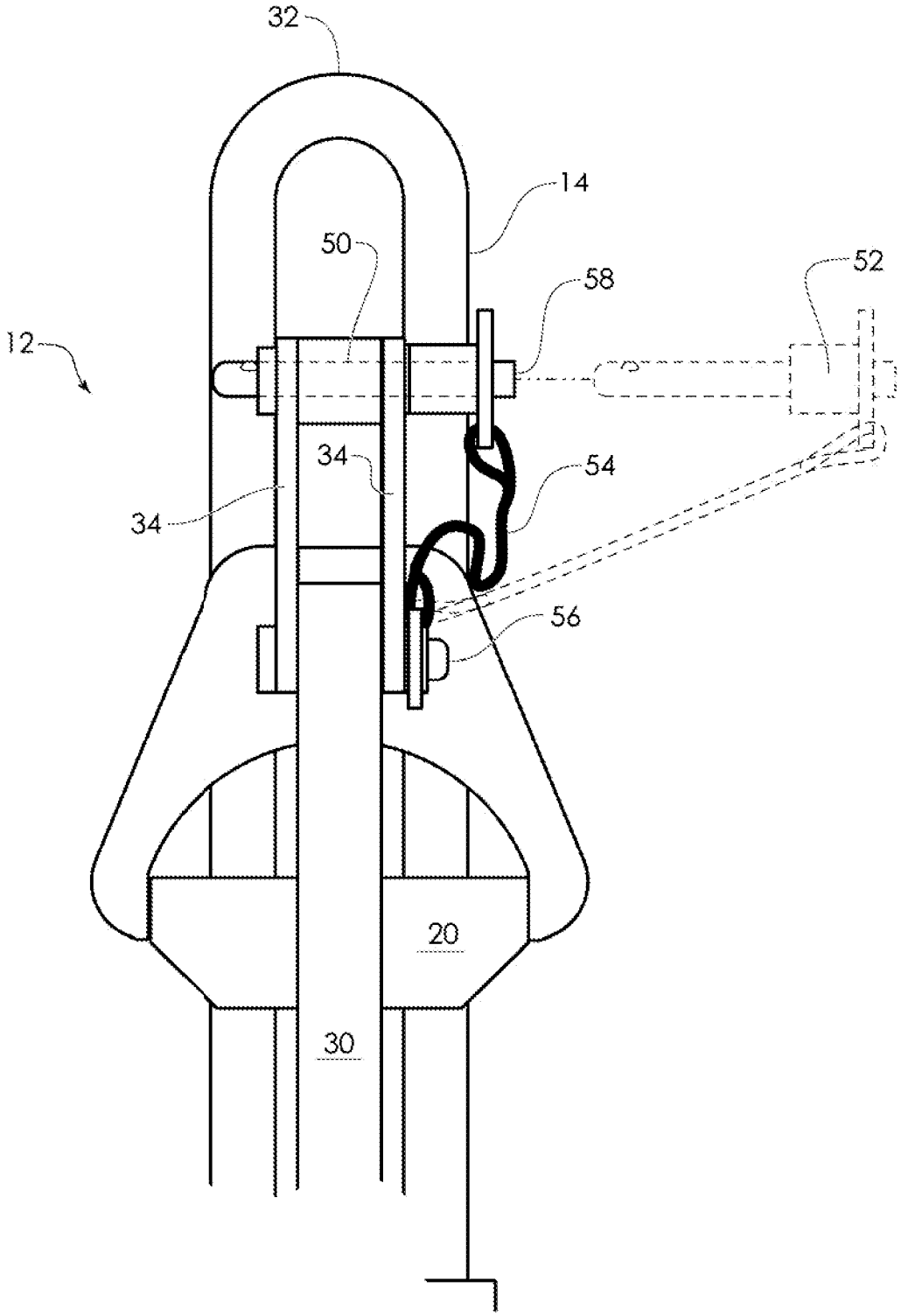
FIG. 12 is a cutaway top view of a releasable attachment for a handle and plate assembly according to an alternative embodiment of the present design.

Also as shown in greater detail in the partial perspective view of FIG. 12, the bar clip 28 and third bar 20 may be configured to mate as shown for quick release. The bar clip 28 seen from the side in FIGS. 11A and 11B simply slides over the adjacent bar 20. Note the shape of the bar 20 has been modified to provide a slot or section out to accommodate the bar clip 28 as shown. This embodiment allows the user to remove the bar clip 28 from the adjacent bar 20, and then the remaining part of the unloading mechanism may be removed by removing the axle 58 from the opening 50. Otherwise, these features may be present for manufacturing but affixed with a nonremovable pin for an axle 58.

Should the user alternatively want a dual function, this shoulder retainer may be replaced by a ball lock pin 52 to allow for fast conversions from belay to lower and back again, if required. The ball lock pin 52 shown is attached via a cord 54. The ball lock pin 52 is provided at the axle or opening 50 which attaches the handle 30 to the frame 14 in a manner such that the attachment may rotate about the axle at 58 (when the pin 52 is in the opening 50). The brace 34 extends from the axle at 58 to the handle 30 where another opening with pin or axle at 56 is provided. The handle 30 in this embodiment is rotatably attached to the bar clip 28 at that axle 60 disposed on one side thereof as shown. FIG. 4A shows the brace 34 being attached to the axles 56 and 60 to provide an alternative angling to the handle 30 to alternative release or belay positions. Additionally, the end bar 16 may have pens, openings, hooks to accommodate accessories or additional functionality at 44.

A pre-rigged prototype safety lowering device and system is an ultra safe lowering device for use in rope rescue. Constructed of high strength metals, primarily stainless steel, it is designed for years of trouble free operation in urban fire and rescue environments. Initially conceived for single rope rescue from the roofs of tall buildings, the safety lowering device can be used to lower up to six hundred pounds in an easy and secure fashion on 12 to 15 millimeter static kern-mantle and laid rescue rope as well as heat resisting aramid fiber ropes. In the pre-rigged prototype the middle bar 18 cannot be rotated out and therefore the device must be pre-rigged from the end of the rope R preventing any possibility of the device 12 coming separated from the rope R during use, in bags, or in shipment.

In use, the device 12 should always be inspected for proper rigging and damage before and after use. It is important hat the user be properly trained in the use of this device 12. When constructing the anchor, proper care should be taken to avoid any obstructions near the device 12 that might interfere with its proper functioning. When loaded the lever 30 will automatically pivot from a parallel orientation (release position) to the frame to a near right angle orientation (belay position) in the embodiments depicted in FIGS. 1-3, 4B, 11A, and 11B. Lowering the load is accomplished by moving the lever 30 away from the anchor and towards the load. To increase control when lowering a two person load, bring the slack end of the rope up between the abutment nuts 22, and feed rope R with one hand while operating the lever 30 with the other hand. This increases control by adding friction.

At any point while the system is loaded, if the operator lets go of the lever 30, rope movement through the device will be safely and automatically arrested. After the completion of the lower, the unloaded rope can easily be pulled back through the device by holding the lever parallel to the frame, spreading the break bars 16, 18, 20, while a second rescuer pulls the rope through the device from the slack end of the rope. this resents the system for the next lower, if the loaded system is to be unattended take a half hitch on a bight from the slack side and clip it to the load side effectively applying a hark lock to the system. Should the unloading parts need to be removed, a ⅛ inch hex wrench and ⅜ inch open end wrench are required to remove stainless steel shoulder bolt. The handle grip 48 may be a conventional grip, or a ball grip 48. The grip 48 may be replaced by an eye bolt (not shown) for remote actuation via a chord.

It is to be understood that the present invention is not limited to the embodiments described above, but encompasses any and all embodiments within the scope of the following claims.

What is claimed is:

1. A safety rappelling rope controller lowering device, comprising:

an elongated frame base member with a closure end, and a pair of parallel arms spaced apart by opposite spaced free ends;

first and second bars of rounded cross section each having a pair of spaced apart, peripherally closed openings confining therein the spaced apart arms of the base member;

at least a third bar of rounded cross section having a pair of spaced apart openings;

stop means on the free ends of the arms for preventing removal of the bars from the arms;

a first of the bars being located adjacent the stop means on the arms;

a second of the bars being located adjacent the closure end;

the at least one third bar being located between the first and second bars;

the second bar being slidable freely along the base member arms between the closure end and abutment with the at least one third bar;

the at least one third bar being slidable freely along the base member arms between abutment with the first bar and abutment with the second bar; and an elongated handle pivotally attached to the base member between the closure end and the second bar, and attached to the second bar wherein the handle operates as a lever to control movement of the second bar along the arms towards the closure end.

2. The controller of claim 1, further comprising:

at least a second third bar having a notched opening for releasably receiving a spaced apart arm of the base member.

3. The controller of claim 1, wherein:

the at least one third bar of rounded cross section having a pair of spaced apart, peripherally closed openings confining therein the spaced apart arms of the base member.

4. The controller of claim 3 wherein:

the handle telescopes to provide greater force.

5. The controller of claim 3 wherein:

the handle is attached to the second bar via a bar clip;

the bar clip having opposing hooks that slidably hold the bar ends.

6. The controller of claim 5, wherein:

the second bar having opposing slots opposite the closed end configured to receive the opposing hooks of the bar clip; and the bar clip is configured to releasably attaches thereto.

7. The controller of claim 3, wherein:

the first bar has accessory attachment openings, notches, or fittings facilitated between each opening and opposing ends of the first bar.

8. The controller of claim 3 wherein the closure end of the base member provides a connecting support for a load to be rappelled.

9. The controller of claim 3 wherein all the bars are movable along the base member arms and the first bar is slidable freely along the base member arms between abutment with the stop mean and abutment with the at least one third bar.

10. The controller of claim 3 wherein the stop means on the free ends of the arms are nuts secured removably to the free ends.

11. A safety rappelling rope controller lowering device, comprising:

an elongated frame base member with a closure end, and a pair of parallel arms spaced apart by opposite spaced free ends;

first and second bars of rounded cross section each having a pair of spaced apart, peripherally closed openings confining therein the spaced apart arms of the base member;

a third bar of rounded cross section having a pair of spaced apart openings;

stop means on the free ends of the arms for preventing removal of the bars from the arms;

the first of the bars being located adjacent the stop means on the arms;

the second of the bars being located adjacent the closure end;

the third bar being located between the first and second bars;

the second bar being slidable freely along the base member arms between the closure end and abutment with the third bar;

the third bar being slidable freely along the base member arms between abutment with the first bar and abutment with the second bar; and an elongated handle pivotally attached to the base member between the closure end and the second bar, and attached to the second bar wherein the handle operates as a lever to control movement of the second bar along the arms towards the closure end.

12. The controller of claim 11 wherein:

the handle telescopes to provide greater force.

13. The controller of claim 11 wherein:

the handle is attached to the second bar via a bar clip;

the bar clip having opposing hooks that slidably hold the bar ends.

14. The controller of claim 13, wherein:

the second bar having opposing slots opposite the closed end configured to receive the opposing hooks of the bar clip; and the bar clip is configured to releasably attaches thereto.

15. The controller of claim 11, wherein:

the third bar of rounded cross section having a pair of spaced apart, peripherally closed openings confining therein the spaced apart arms of the base member.

16. The controller of claim 11, wherein:

the third bar has a notched opening for releasably receiving one of the spaced apart arm of the base member.

17. The controller of claim 14, wherein:

the first bar has accessory attachment openings, notches, or fittings facilitated between each opening and opposing ends of the first bar.

18. The controller of claim 17 wherein:

the closure end of the base member provides a connecting support for a load to be rappelled.

19. The controller of claim 17 wherein all the bars are movable along the base member arms and the first bar is slidable freely along the base member arms between abutment with the stop mean and abutment with the at least one third bar.

20. The controller of claim 17 wherein the stop means on the free ends of the arms are nuts secured removably to the free ends.

* * * * *